United States Patent [19]

Hamaguchi et al.

[11] 4,028,687

[45] June 7, 1977

[54] METHOD AND APPARATUS FOR DELIVERY ALARM FOR LIVESTOCK ANIMALS

[75] Inventors: Sachihiko Hamaguchi; Ikuo Oomura; Tadashi Sato, all of Tokushima; Hisashi Wada, Takamatsu, all of Japan

[73] Assignee: Matsushita Electric Industrial Co., Ltd., Kadoma, Japan

[22] Filed: Sept. 8, 1975

[21] Appl. No.: 611,150

Related U.S. Application Data

[63] Continuation of Ser. No. 435,245, Jan. 21, 1974, abandoned.

[30] Foreign Application Priority Data

| | | |
|---|---|---|
| Feb. 27, 1973 | Japan | 48-24166 |
| May 17, 1973 | Japan | 48-55396 |
| May 8, 1973 | Japan | 48-54391[U] |
| May 8, 1973 | Japan | 48-54406[U] |
| May 15, 1973 | Japan | 48-57669[U] |
| May 15, 1973 | Japan | 48-57670[U] |

[52] U.S. Cl. ..... 340/201 R; 128/2 R; 128/2.1 A; 340/279

[51] Int. Cl.[2] ..... G08B 21/00

[58] Field of Search ..... 340/177 R, 201 R, 213 R, 340/279, 181; 325/113, 114, 118; 128/2 R, 2 S, 2.1 A, 130; 119/1

[56] References Cited

UNITED STATES PATENTS

| | | | |
|---|---|---|---|
| 1,896,071 | 2/1933 | Clark | 128/130 |
| 3,273,559 | 9/1966 | Evans | 128/2 R |
| 3,274,994 | 9/1966 | Sturm | 128/2 H |
| 3,583,389 | 6/1971 | Harvey | 128/2 R |

*Primary Examiner*—John W. Caldwell
*Assistant Examiner*—James J. Groody
*Attorney, Agent, or Firm*—Stevens, Davis, Miller & Mosher

[57] ABSTRACT

An alarm apparatus for the delivery of livestock animals is inserted in the birth canal of a pregnant livestock animal such as a cow or a pig whose delivery is expected to be close at hand, so that it may warn of the onset of delivery and the necessity to take care for the delivery, etc. when it is pushed out of the birth canal by a fetus at the time of the onset of delivery.

6 Claims, 16 Drawing Figures

METHOD AND APPARATUS FOR DELIVERY ALARM FOR LIVESTOCK ANIMALS

This is a continuation of application Ser. No. 435,245 filed Jan. 21, 1974, now abandoned.

This invention relates to an improved method and apparatus for warning of the farrowing or delivery of livestock animals such as pigs and cows.

When pregnant livestock animals such as cows and pigs deliver, it is necessary to help the farrowing or delivery to assure safe birth. However, when there are a great number of pregnant livestock animals expecting delivery or the pregnant animal is at a distant place and cannot always be attended by a helper, the onset of the delivery should be automatically detected and information given to the helper for this assistance.

In a prior art method of informing of the delivery of livestock animals, for instance, pigs, a pregnant pig whose expected day of delivery is near at hand is held in a farrowing stall in such a state that the pig delivers on one of a pair of parallel iron plates which have an area of about 1 square meter and are tied together at several points by means of springs with a microswitch arranged between the two iron plates. The microswitch is adapted to be actuated by the weight of a farrow delivered, thereupon operating a buzzer or the like which is arranged at a distant place to alarm the keeper of the delivery. In this method, however, it is necessary that the pregnant pig must deliver a fetus on to the iron plate. Also, the microswitch will be actuated if the mother pig accidentally steps on the iron plate. Further, since the delivery table consists of the iron plates, the apparatus is large in size, heavy in weight and inconvenient to handle. Furthermore, a farrow immediately after its birth is likely to be injured by the iron plate. Still further, it is necessary to lay a signal transmission line connecting the microswitch equipped in the delivery table with a buzzer etc. installed at a distant place.

The present invention contemplates to elimination of the aforesaid disadvantages.

An object of the present invention is to provide an alarm method capable of automatically giving an alarm at the onset of the delivery of livestock animals such as cows and pigs.

Another object of the invention is to provide an alarm method using a delivery alarm consisting of a transmitter and a receiver and capable of reliably and accurately warning a person, who is at a distant place, of the onset of the delivery.

A further object of the invention is to provide a delivery alarm which can be used for the above purpose.

A further object of the invention is to provide a deivery alarm which can be readily inserted into and readily pushed out of the birth canal of a livestock animal by the fetus.

A further object of the invention is to provide a delivery alarm which is not accidentally pushed out of the birth canal by amniotic fluid etc. and which can accurately give an animal at the onset of the delivery.

A further object of the invention is to provide a delivery alarm which can be readily taken out of the birth canal of a livestock animal at any time when it is unnecessary.

A further object of the invention is to provide a delivery alarm the position of which can be accurately detected when inserted into the birth canal.

A still further object of the invention is to provide a delivery alarm which can reduce the consumption of a power source battery.

According to the invention, the delivery alarm is inserted in the birth canal of a pregnant livestock animal whose expected delivery date is near at hand so that it will give a signal, informing of the onset of delivery, when it is pushed out of the body of the animal by the fetus. Thus, unlike any prior art method no particular delivery table is required, so that it is possible to protect the fetus against injury which may be caused by the iron plate and to prevent false alarms, and it enables the keeper to give appropriate aid by giving an alarm immediately before the delivery. Also, there is no need for the laying of any signal transmission cable.

The above and other objects, features and advantages of the present invention will become more apparent from the following description taken in conjunction with accompanying drawings, in which.

Figure 7:
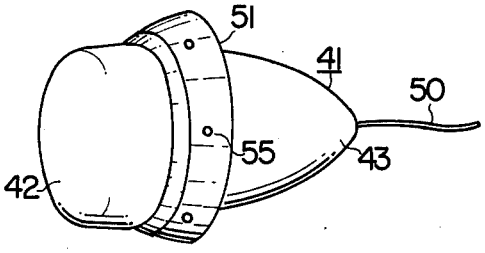
FIG. 7 is a perspective front view showing another example of the delivery alarm according to the invention.
Figure 8:
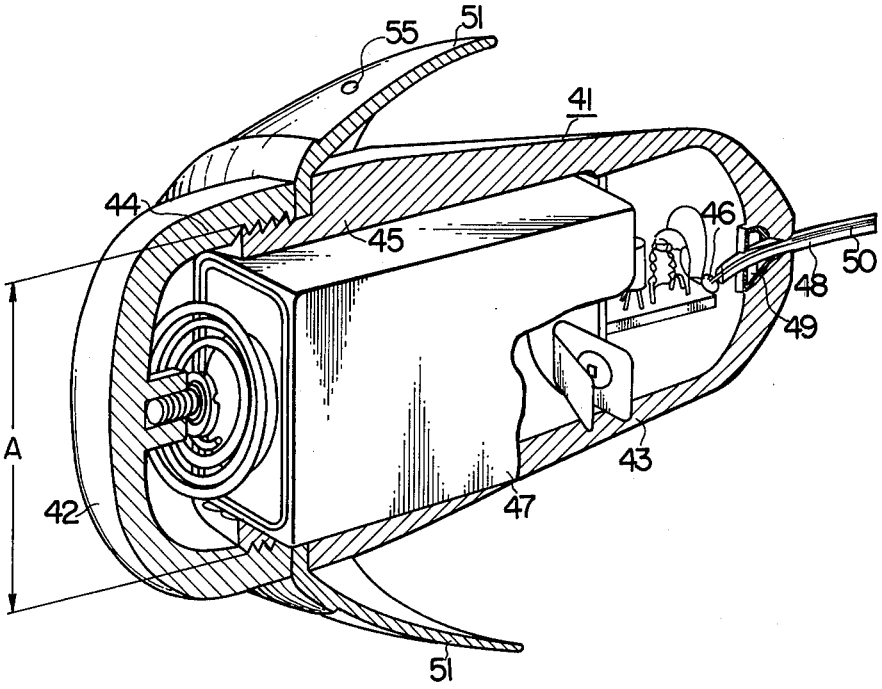
FIG. 8 is a partly broken perspective side view, to an enlarged scale, showing the delivery alarm of FIG. 7.
Figure 9A:
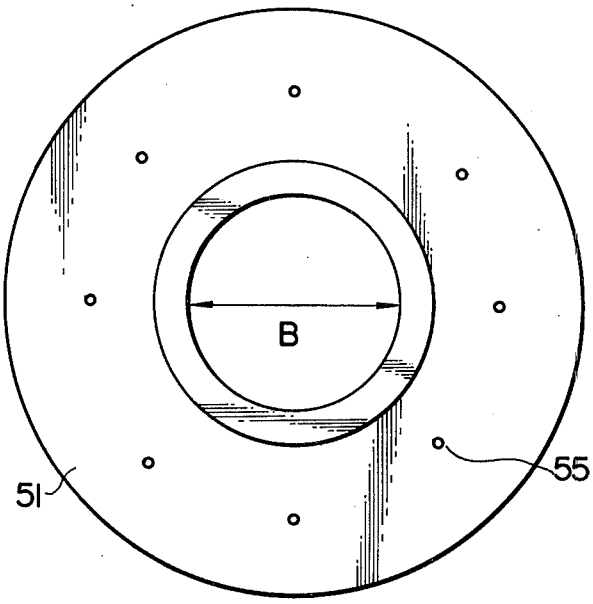
Figure 9B:
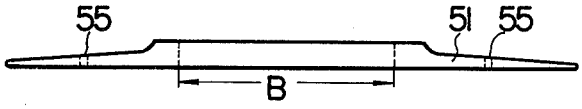
Figure 10:
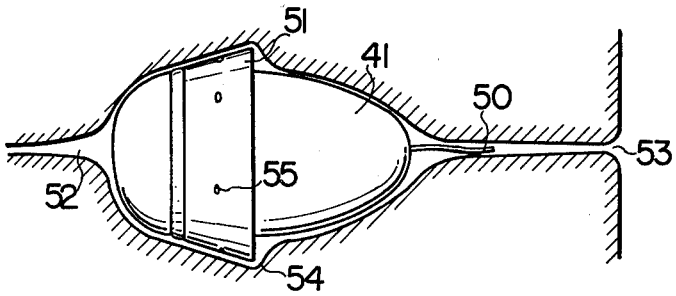
Figure 11:
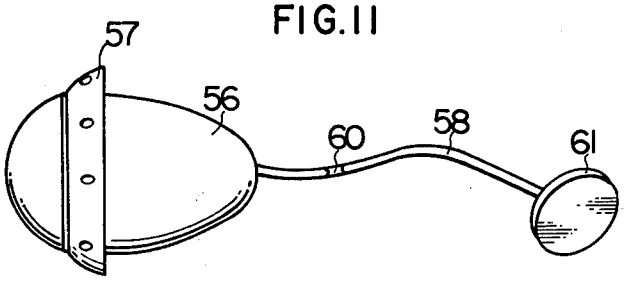
Figure 12:
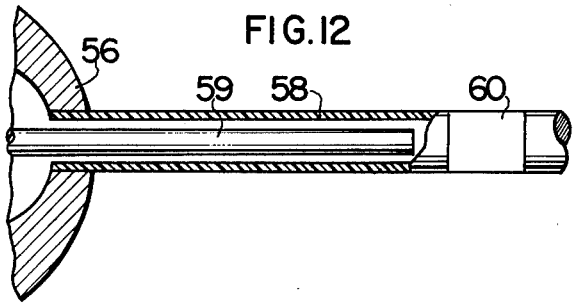
Figure 13:
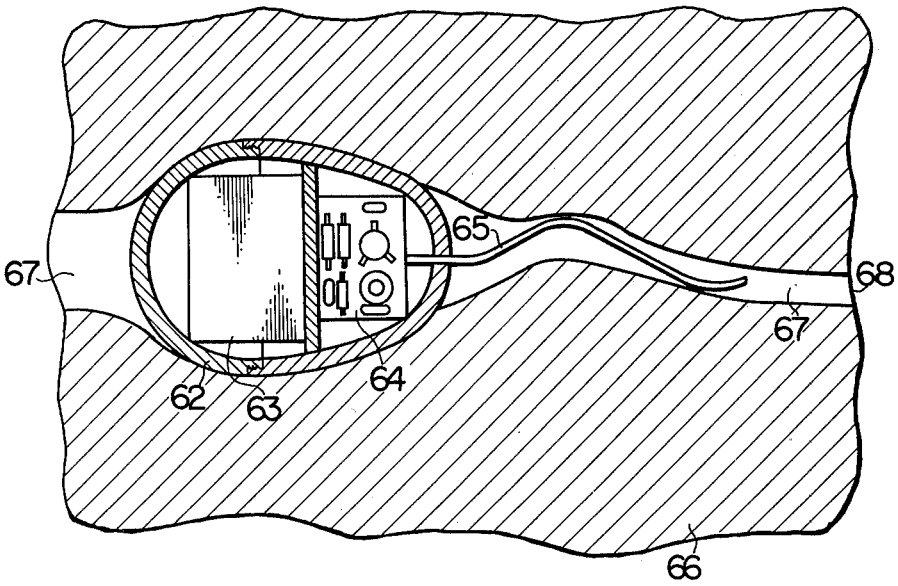
Figure 14:
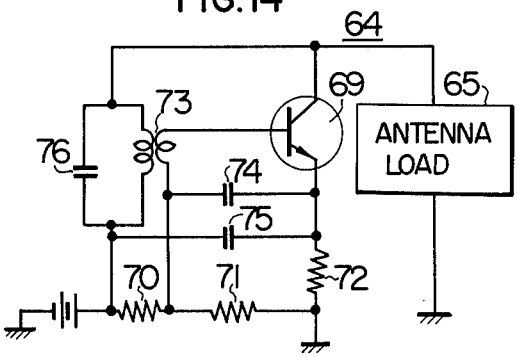
Figure 15:
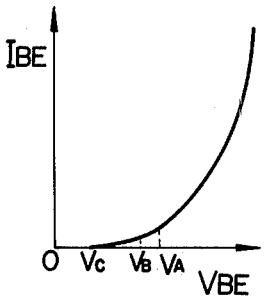

FIGS. 9*a* and 9*b* show a part of the example of FIG. 7;

FIG. 10 is a view showing the example of FIG. 7 inserted in the birth canal of a livestock animal;

FIG. 11 is a front view showing a further example of the delivery alarm according to the invention;

FIG. 12 is a sectional view, to an enlarged scale, showing an essential part of the example of FIG. 11;

FIG. 13 is a sectional view showing a still further example of the delivery alarm according to the invention;

FIG. 14 is a circuit diagram showing the circuit construction of the alarm of FIG. 13; and FIG. 15 is a graph showing a characteristic of an element in the circuit of FIG. 14.

Figure 1:
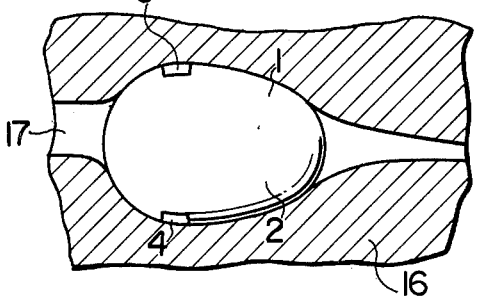
FIG. 1 shows a delivery alarm for carrying out an embodiment of the method of giving an alarm at the delivery of livestock animals according to the invention.
Figure 2:
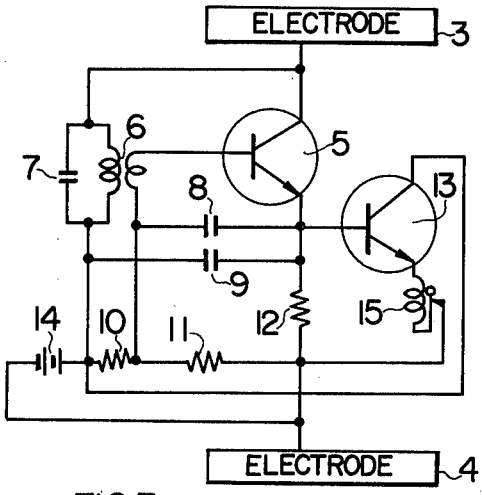
FIG. 2 is a circuit diagram showing the circuit construction of the alarm shown in FIG. 1.

FIGS. 1 and 2 show one embodiment of the invention using a buzzer. Referring to FIG. 1, the delivery alarm 1 is oval-shaped, in which a buzzer and a controller are inserted, and a pair of electrodes 3 and 4 are equipped on the opposite positions at a portion with the largest diameter of the casing 2 made of an insulating material in the delivery alarm 1. FIG. 2 shows an electric circuit constituted by electrodes 3 and 4, a buzzer and a controller of the above delivery alarm. The circuit includes an oscillator constituted by a transistor 5, an oscillator coil 6, capacitors 7 to 9 and bias resistors 10 to 12. The transistor 5 of this oscillator has its emitter connected to the base of a switching transistor 13. A buzzer 15 is connected between the emitter of the transistor 13 and the negative side of a battery 14. The negative terminal of the battery 14 is directly connected to the electrode 4 and its positive terminal is directly connected to a collector of the transistor 13 and a juncture between the resistor 10 and the capacitor 7. The collector of the above mentioned transistor 5 is directly connected to the above mentioned electrode 3.

When the delivery alarm is inserted in the birth canal 17 of a pregnant livestock animal 16 whose delivery is expected to be near at hand, as shown in FIG. 1, the electrodes 3 and 4 are short-circuited to each other through the animal body 16. In this state, the collector of the transistor 5 of the oscillator is grounded through the electrodes 3 and 4 so that there is no feedback from the collector to the base of the transistor 5. Thus, the oscillator is inoperative, and the transistor 13 is "off", that is, there is no current in the buzzer 15 which is thus inoperative.

When the fetus begins to be born through the birth canal, the alarm 1 is pushed out of the animal body by the fetus. As the result, the short-circuit state between the electrodes 3 and 4 disappears, whereupon the oscillator starts oscillation with a feedback signal from the collector of the transistor 5 to the base thereof, thus triggering the transistor 13 to cause the buzzer 15 to sound. By the sound from the buzzer 15 the keeper can be informed of the onset of delivery of the livestock animal.

While the buzzer 15 is used in this embodiment, it may be replaced by any other sound producing means. Also, while the delivery alarm 1 of the above embodiment is adapted to produce sound only when it goes out of the birth canal, it is also possible to use an alarm which has a battery of long life and produce sound at any time even when it is within the birth canal. In this case, since the sound is little detectable when the alarm is within the birth canal, it can be clearly distinguished from that made when the alarm is pushed out. As mentioned above, this embodiment is characterized by inserting the delivery alarm with a built-in buzzer into the birth canal of a livestock animal whose delivery is expected to be close at hand, pushing out the above mentioned deliver alarm by the fetus after the onset of the delivery and alarming the keeper of the onset of the delivery by the sound of the above mentioned buzzer. Since the keeper can thus be automatically informed of the delivery, he need not keep vigil over the pregnant animal.

Figure 3:
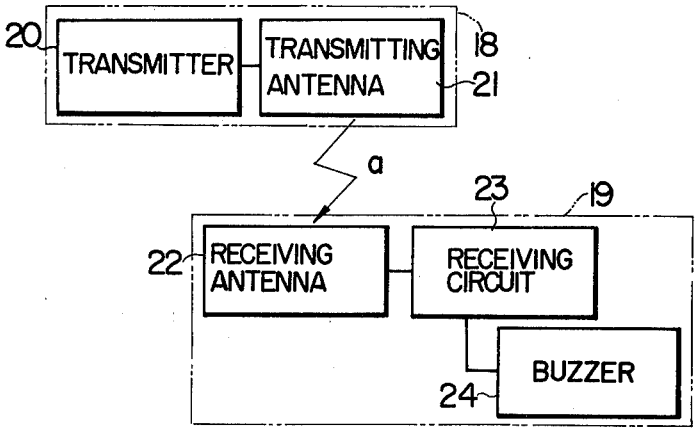
FIG. 3 is a block diagram showing a delivery alarm apparatus for carrying out a second embodiment of the alarm method according to the invention.
Figure 4:
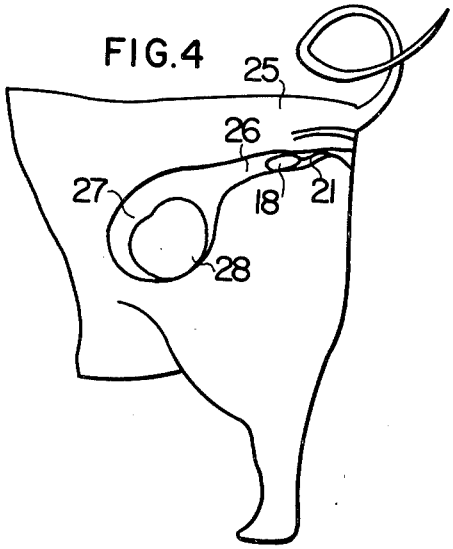
FIG. 4 is a fragmentary pictorial sectional view illustrating the second embodiment.

FIGS. 3 and 4 show another embodiment of the method and the apparatus which use a transmitter and a receiver. Referring to the Figures, reference numeral 18 designates a transmitter for transmitting a signal informing of the onset of the delivery of an animal to a receiver. As shown in FIG. 3, the transmitter 18 comprises a transmitter 20 producing a signal *a* and a transmitting antenna 21. The receiver 19 comprises a receiving antenna 22, a receiving circuit 23 and a buzzer 24 driven by the output of the receiving circuit 23. In FIG. 4, numeral 25 designates a pregnant livestock animal, numeral 26 a birth canal of the animal 25, numeral 27 the uterus connected with the birth canal 26, and numeral 28 the fetus in the uterus 27.

The transmitter 18 comprising oscillator 20 and antenna 21 in the operative state is inserted in the birth canal 26 of the pregnant animal 25 the delivery by which is expected to be near at hand. The transmitter 18 is made to have such a shape and size that it can be readily inserted into the birth canal 26 of the animal 25. The transmitter 18 inserted in the birth canal 26 of the animal 25 thus continuously oscillates. However, the body of the animal 25 serves as a shield, and the electromagnetic wave from the transmitter 18 held within the birth canal 26 of the animal does not substantially leak toward the outside. The frequency of the signal from the transmitter 18 must be set to an adequate value so that the signal will not substantially leak toward the outside of the body of the animal 25.

When the delivery begins, the transmitter 18 is pushed out of the birth canal 26 of the animal 25 by the fetus 28 about to be born. With the transmitter 18 thus pushed out of the body of the animal 25, its output signal *a* at a predetermined frequency is received by the receiver 19 provided in the neighborhood of the keeper. More particularly, the signal *a* from the transmitter 18 is received by the receiving antenna 22, whose output is coupled to the receiver circuit 23, which then drives the buzzer 24. In this way, the keeper can be informed on the onset of the delivery of the livestock animal 25.

As a modification of this embodiment, it is possible to provide the buzzer 24 separately from the rest of the receiver 19. Also, the buzzer may again be replaced by any other suitable informing means. Further, a similar result may be obtained by constructing the transmitter 18 such that it is inoperative when set in the body of the livestock animal 25 and starts oscillation with an impact given when pushed out of the body of the animal 25.

As is clear by the above mentioned embodiment, the transmitter consisting of an oscillator and a transmitting antenna is inserted into the birth canal of a livestock animal the delivery by which is expected to be near at hand, and the transmitter starts working when pushed out of the body of the animal by the fetus after the onset of the delivery, by which the receiver installed in another place gives the owner an alarm of the onset of delivery. Since the keeper can thus be informed of the delivery, he need not always keep vigil on the pregnant animal. Also, there is no need for preparing any special delivery bed as in the prior art, and hence it is possible to prevent an injury to the born young. Further, malfunctioning of the alarm can be eliminated. Furthermore, unlike the prior art the keeper can be informed of the farrowing not after but immediately before the delivery, so that he may undertake appropriate treatment immediately. Moreover, since the transmitter and receiver are coupled together by means of electromagnetic waves, it is not necessary to lay a signal transmission cable.

Figure 5:
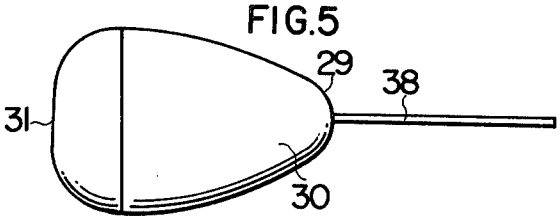
FIG. 5 is a front view of an example of the delivery alarm according to the invention.
Figure 6:
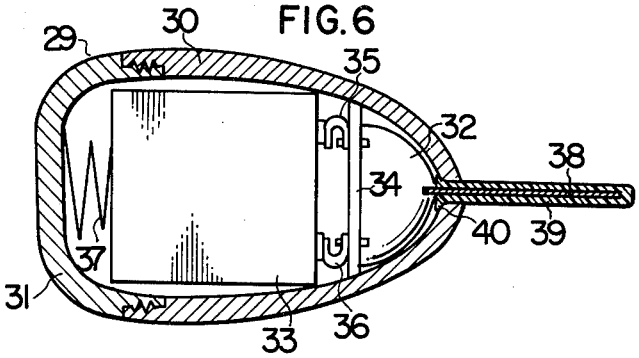
FIG. 6 is a sectional view, to an enlarged scale, showing the delivery alarm of FIG. 5.

Now, an example of the delivery alarm according to the invention capable of ready insertion into and removal from the birth canal of the livestock animal will be described with reference to FIGS. 5 and 6. In the Figures, reference numeral 29 designates a delivery alarm. Its case consists of a main case body 30 and a cap 31 screwed thereto. Accommodated within the cases 30 and 31 are an oscillator 32 producing an alarm signal and a battery 33 as its power source. Both the oscillator 32 and battery 33 are electrically connected with each other by contact pieces 35 and 36 fixed on an insulating plate 34. Numeral 37 is a spring which pushes the battery 33 from the back side. Numeral 38 designates a transmitting antenna connected to the oscillator 32 and projecting outside from the case body 30. The antenna 38 may be preferably made of a stranded wire which is readily flexible to thereby prevent the wall of the birth canal from being injured when it is inserted into the birth canal of the livestock animal. The antenna 38 is covered with a cover 39 of such a material as vinyl plastics or rubber. The cover 39 is provided at its open end with a stopper 40 so that it will not detach from the case. The cover 39 also serves as a seal between case body 30 and antenna 38. The length of the antenna 38 is shortened to a fraction of the oscillation wavelength obtained by being divided by an integer. It the antenna 38 is too long, it will partly project from the mouth of the birth canal. In such a case, the alarm signal is always transmitted without being suppressed by the body of the animal, which is undesirable.

The case consisting of case body 30 and cap 31 has an oval shape as a whole. It is made of a plastic material or metal, and it has a smooth outer surface. Since the case is oval, it can be readily inserted with its large diameter end portion firstly into the birth canal, and once it is inserted in the birth canal and held in the normal state it will not be accidentally expelled from the animal body. If it is inserted in the reverse state, it is likely to be accidentally expelled by being forced toward the mouth of the birth canal owing to the contraction thereof.

While in this example the whole outer surface of the case is curved and made smooth, only the outer surface portion in contact with the birth canal may be curved and smooth. While the oval shape permits ready insertion of the case and prevents accidental expulsion from the birth canal, a nearly spherical or conical shape may also permit ready insertion into the birth canal and ensure getting out of the birth canal when pushed by the fetus, provided the surface portion of the case in contact with the birth canal is curved and smooth.

Further, in addition to the embodiment in which the oscillator 32 is always operative, a similar result may be also obtained by constructing the oscillator such that it becomes operative only when the case is pushed out of the birth canal. Still further, the oscillator may be replaced by a buzzer or other sound generators. In such a case, the keeper will be directly informed of the delivery by the sound of the buzzer or the like.

As has been shown, the alarm case according to the embodiments of this invention is the one which has a curved and smooth surface at a portion in contact with the birth canal, which contains a signal generator such as an oscillator warning of the delivery when pushed out of the birth canal of the livestock animal, and which can be readily inserted into the birth canal of the livestock animal and pushed out of the body by the fetus.

FIGS. 7 and 10 show another example of the delivery alarm according to the invention which will not be accidentally pushed out of the birth canal by amniotic fluid and can reliably give information of the delivery. In the figures, numeral 41 designates a case of the delivery alarm. Its outside view is nearly oval, and it is divided into a front portion 42 and a rear portion 43, these portions halves are screwed together at their respective threaded portions 44 and 45. The case accommodates an oscillator 46 for generating a delivery alarm signal and a battery 47. An antenna 50 is drawn out of an antenna outlet 48 at the rear end of the rear half through a liquid tight bushing 49. By inserting this delivery alarm in the birth canal of a pregnant livestock animal expected to breed in the proximate future and providing a receiver and an alarm bell or the like near the keep, an alarm signal will be received by the receiver when the alarm is pushed out of the birth canal by the fetus to be born, so that the delivery may be signalled.

However, if the case to be inserted in the birth canal has a merely oval shape, there is a possibility that the case may be pushed out of the birth canal by amniotic fluid at the time of rupture of the membrane in the case of a multipara livestock animal. Accordingly, in this device the case 41 is provided with an elastic annular projection 51 of such a material as rubber or plastic extending from the periphery of the case 41 and flaring rearwardly, that is, toward the mouth of the birth canal. As shown in FIG. 10 when this case is inserted in the birth canal 52 of the livestock animal such as a pig etc. from the mouth of a birth canal 53 the elastic annular projection 51 engages the wall 54 of the birth canal and acts as an anchor to prevent the case from accidentally getting out of the birth canal. As shown in FIGS. 9*a* and 9*b* in order to fix such a slant elastic annular projection 51, the projection 51 consisting of a ring-like elastic member having an inner diameter B smaller than the outer diameter A of the threaded portion 45 of the rear half 43 of the case 41 may be mounted on the threaded portion 45 of the rear hald 43 in such a manner as to forcibly spread out its inner diameter B and may be clamped between the front and rear halves 42 and 43 of the case. Thus, the inside portion of the elastic projection member 51 intervening between the front and rear halves 42 and 43 of the case 41 serves as a packing to prevent liquid such as a disinfectant liquid and amniotic fluid from entering the interior of the case 41.

Also, the elastic projection member 51 is provided with many holes 55, through which disinfectant liquid and amniotic fluid can flow when the alarm is inserted in the birth canal 52. With this means, the possibility that the alarm is accidentally pushed out of the birth canal due to amniotic fluid can be eliminated.

The way method of installation of the annular projection member is by no means limited to the above example, the member may be mounted by any other suitable means as well. Also, the shape of the projection member itself is not limited to that of the above example. For example, it may be radially divided into a plurality of sections, and in this case the holes are not needed. Further, this apparatus may be employed for any livestock animal other than cows and pigs. It is desirable that the aforementioned projection is an elastic member to thereby prevent the birth canal of the livestock animal from being injured, but it may be a rigid member having a smooth outer surface. Also, it may be of any configuration in as much as it serves as an engagement piece engaging the wall of the birth canal. Moreover, the oscillator provided within the case may be replaced by a buzzer or the like sound producing means or any other alarm signal producing means.

FIGS. 11 and 12 show a further example of the delivery alarm, which can be taken out at any time. In FIGS. 11 and 12, reference numeral 56 designates the main part of the delivery alarm having an oscillator of a predetermined oscillation frequency and a battery, both accommodated within a case provided with a peripheral annular projection 57 serving as anchor to prevent the accidental detachment of the case from the birth canal. The alarm 56 located at the outlet side of the birth canal is provided with a hollow take-out string 58 extending from its rear end. Accommodated within the hollow take-out string 58 is an antenna 59 having a length equal to a fraction obtained by dividing the oscillation wavelength by an integer. The string 58 is provided with a marking 60 around its periphery at a position corresponding to the free end of the antenna 59. It is also provided at its end remote from the alarm with a stopper disc 61 secured to it. With this means, the alarm can be prevented from reaching the uterus through the birth canal. In inserting the alarm 56 into the birth canal of the livestock animal, the complete insertion of the antenna into the body can be also recognizable when the string 58 is inserted up to the position of the marking 60. In this way, it is possible to prevent any accidental radiation of the electromagnetic wave. Further, any excessive insertion of the alarm can be prevented by virtue of the stopper disc 61. Furthermore, since the portion of the string 58 adjacent to the marking portion 60 is not inserted but hangs from the animal body, the alarm may be removed at any time by pulling the hanging string. While in this embodiment the antenna 59 is accommodated within the hollow take-out string 58, this accommodation is not essentially necessary, but it is also possible to arrange such that the antenna is made merely integral with the take-out string.

FIGS. 13 to 15 show a still further example of the delivery alarm according to the invention, which can reliably inform signal the delivery and with which the service life of the battery can be prolonged. Referring to FIG. 13, reference numeral 62 designates a case of the alarm. The case 62 accommodates a battery 63 and an oscillator 64, and it is provided with an antenna 65 extending from its rear end for transmitting the oscillation signal. The case 62 with the antenna 65 is inserted into the birth canal 67 of a pregnant livestock animal 66, the delivery by which is expected to be near at hand, from the mouth 68 of the birth canal, and the oscillation signal is transmitted to a receiver when the case with the antenna is pushed out of the birth canal by the fetus, thereby signalling informing the beginning of the delivery, for instance, by causing a buzzer to sound. FIG. 14 shows the circuit of the oscillator 64. It comprises a transistor 69, bias resistors 70 to 72, oscillator coil 73 and capacitors 74 to 76.

The output of the transistor 69 provided at the collector thereof is distributed to the antenna load 65 and the base circuit including the oscillator coil 73 and capacitor 76. When the antenna load is light, a portion of the output of the transistor 69 is provided to the base circuit; thus, the output of the transistor is fed back to its base and oscillation takes place. When the antenna load is heavy, the portion of the output of the transistor coupled to the base circuit becomes small; therefore, the oscillation is stopped or substantially stopped. The antenna 65 constitutes a variable load of the oscillator. The base bias voltage on the transistor 69, whose characteristics is shown in FIG. 15, is set such that oscillation takes place when the load constituted by the antenna 65 is low, while oscillation is about to start when the load is heavy. More particularly, the base bias voltage $V_A$ when the resistance 72 is zero is set to be slightly higher than the base current cut-off voltage $V_C$ (thus, the base bias voltage becomes $V_B$ when the resistance 72 is not zero), so that the load current in the transistor 69 is set to a sufficiently small value. By doing so, sufficient feedback from the collector circuit to the base circuit of the transistor 69 is provided to increase the current, thereby starting oscillation, when the load of antenna 65, which is variable, is light. On the other hand, when the variable load of antenna 65 is heavy, the amount of feedback is reduced, so that the oscillation is stopped or substantially stopped, thus reducing the current substantially to zero. When the case 62 and antenna 65 of the delivery alarm are inserted in the birth canal 67 of the livestock animal 66, the antenna 65 is in a very heavy load state, since it is in close contact with the birth canal 67, or due to the presence of amniotic fluid or other secretion liquid.

When the case 62 is within the birth canal 67, the antenna lead and the inner-wall of the birth canal 67 are coupled with a relatively large capacity since the antenna is in close contact with the birth canal 67. The inner-wall of the birth canal 67 and the grounded oscillator conductor within the case 62 are also coupled with a relatively large capacity through the case 62 since the case is in close contact with the birth canal 67. Electrically, the presence of amniotic fluid or other secretion liquid has the effect or narrowing the birth canal and this leads to an increase of the above capacities. Thus, the antenna lead and ground are coupled with relatively large capacity when the case 62 is inserted in the birth canal 67. With reference to FIG. 14, a relatively large capacity is inserted between the collector of the transistor 69 and ground as an antenna load. At the oscillator frequency, which is a high frequency, the value of the antenna load becomes very low; thus, the antenna load becomes heavy and the oscillation is stopped or substantially stopped. On the other hand, when the alarm is pushed out of the birth canal 67 by the fetus, the antenna 65 is released from the previous heavy load state and becomes a light load. Thus, the oscillator circuit 64 is inoperative or almost inoperative and carries very slight current when the alarm is within the birth canal 67 (i.e., before the beginning of delivery), and it starts strong oscillation only when the alarm is pushed out of the birth canal 67 (i.e., when delivery commences). In this way, the onset of the delivery is signalled.

It will be appreciated that, with the delivery alarm of the above construction, the oscillation output of the oscillator is substantially or entirely absent before the onset of the delivery, so that the onset of the delivery can be signalled very reliably and accurately, and it is possible to eliminate the malfunctioning due to leakage signal from the body of the animal 66 as in case of using an oscillator which is always operative. Also, since current consumption is very slight before the onset of the delivery, it is possible to positively reduce the drain on the battery 63 to prevent the battery from being fully consumed and prolong the life of the battery even if the time from the insertion into the birth canal 67 of the animal 66 to the onset of the delivery is prolonged, the U.S. allowing even in such a case a sufficiently strong oscillation signal to be radiated to reliably signal the onset of the delivery.

The circuit construction of the oscillator 64 is not limited to the one as described above, but any other suitable oscillator circuit may be used so long as it is perfectly or almost perfectly inoperative under high antenna load condition and starts intensive oscillation only when the antenna load is reduced.

What we claim is:

1. Apparatus for providing an alarm upon the delivery of a livestock animal, comprising a case for insertion into the birth canal of said livestock animal, said case being pushed out of said birth canal during delivery of a fetus, a transmitter including an oscillator located within said case for producing a delivery alarm signal, and an antenna coupled to said oscillator as a load thereof and extending outside and away from said case and toward the mouth of said birth canal, said oscillator being continuously supplied with electric power and biased such that when the load on said antenna is heavy, the oscillation is substantially stopped near the state where the oscillation is about the start, and when the load on said antenna is relatively high, an oscillation is started; the load on said antenna being heavy when the antenna is within the birth canal, and becoming relatively light causing the antenna to emit a signal from the oscillator when the antenna is pushed out of the birth canal.

2. The apparatus according to claim 1, wherein said case is divided into two portions and has an outer wall, said apparatus further comprising an elastic annular flange clamped between the two portions of said case and projecting from the outer wall of said case for anchoring said case in said birth canal.

3. The apparatus according to claim 2, wherein said elastic annular flange is provided with means for permitting amniotic fluid to pass therethrough.

4. The apparatus according to claim 1, which further comprises a take-out string enclosing said antenna.

5. The apparatus according to claim 4, which further comprises a stopper attached to said take-out string for butting against the mouth of the birth canal and preventing excessive insertion of said case and antenna in said birth canal.

6. The apparatus according to claim 1, wherein said oscillator comprises a transistor coupled to said antenna, and means for biasing said transistor to substantially stop oscillation of said oscillator when said antenna is within the birth canal of said animal and start to oscillate when said antenna is expelled from said birth canal.

* * * * *